United States Patent [19]

Thuries et al.

[11] Patent Number: 4,715,834

[45] **Date of Patent: * Dec. 29, 1987**

[54] CONNECTOR FOR A TELESCOPIC ISOLATING SWITCH

[75] Inventors: Edmond Thuries, Meyzieu; Jean-Paul Masson, Villeurbanne; Louis Malik, Caluire, all of France

[73] Assignee: Alsthom-Atlantique, Paris, France

[ * ] Notice: The portion of the term of this patent subsequent to Sep. 29, 2003 has been disclaimed.

[21] Appl. No.: 739,587

[22] Filed: May 30, 1985

[51] Int. Cl.[4] ..... H01R 13/11

[52] U.S. Cl. ..... 439/842

[58] Field of Search ..... 439/842, 851, 852, 856, 439/857, 862

[56] References Cited

U.S. PATENT DOCUMENTS 3,805,220 4/1974 Silbermann ..... 439/851

*Primary Examiner*—Joseph H. McGlynn

*Attorney, Agent, or Firm*—Sughrue, Mion, Zinn, Macpeak & Seas

[57] ABSTRACT

A connector for electrical and mechanical connection to an overhead conductor (1) and for constituting the female portion of a telescopic isolating switch suitable for co-operating electrically with a male portion (6) of said switch. The connector includes the improvement whereby it comprises a plurality of metal conductors (17) which are curved and regularly disposed in such a manner as to define meridians of a substantially spherical surface, the top ends of said conductors being fixed to a metal block (2A–2B) which is electrically connected and mechanically fixed to said overhead conductor. The bottom ends of said curved metal conductors each include a rectilinear portion (7A) which is inclined relative to the vertical in such a manner as to define an inlet cone for the male connector portion, followed by a hairpin bend portion having two arms, one of which serves as a contact finger for making electrical contact with the male connector portion.

6 Claims, 6 Drawing Figures

CONNECTOR FOR A TELESCOPIC ISOLATING SWITCH

The present invention relates to a connector for a telescopic isolating switch. It relates more particularly to the female portion of the connector intended to be fixed to an overhead wire in an electricity station and to receive the male portion of the connector when telescopic members are extended.

BACKGROUND OF THE INVENTION

There are many problems to be solved when making a good connector.

The connector must have sufficient mass to ensure that the rod penetrates therein, but it must not have a large mass since an excessively heavy connector is also excessively expensive.

The connector must ensure adequate contact pressure on the contact rod at the male end of the connector.

The connector must be designed in such a manner as to guide the contact rod during a connector closure operation regardless of the changes in vertical position of the overhead conductor due to changes in atmospheric conditions.

The connector must be shaped so as to distribute the electric field evenly and avoid glow discharges.

Preferred embodiments of the present invention meet all of the above-mentioned requirements.

SUMMARY OF THE INVENTION

The invention provides a connector for electrical and mechanical connection to an overhead conductor and for constituting the female portion of a telescopic isolating switch suitable for co-operating electrically with a male portion of said switch, the connector including the improvement whereby it comprises a plurality of metal conductors which are curved and regularly disposed in such a manner as to define meridians of a substantially spherical surface, the top ends of said conductors being fixed to a metal block which is electrically connected and mechanically fixed to said overhead conductor, the bottom ends of said curved metal conductors each including a rectilinear portion which is inclined relative to the vertical in such a manner as to define an inlet cone for the male connector portion, followed by a hairpin bend portion having two arms, one of which serves as a contact finger for making electrical contact with the male connector portion.

BRIEF DESCRIPTION OF THE DRAWINGS

Embodiments of the invention are described by way of example with reference to the accompanying drawings, in which.

MORE DETAILED DESCRIPTION

Figure 1:
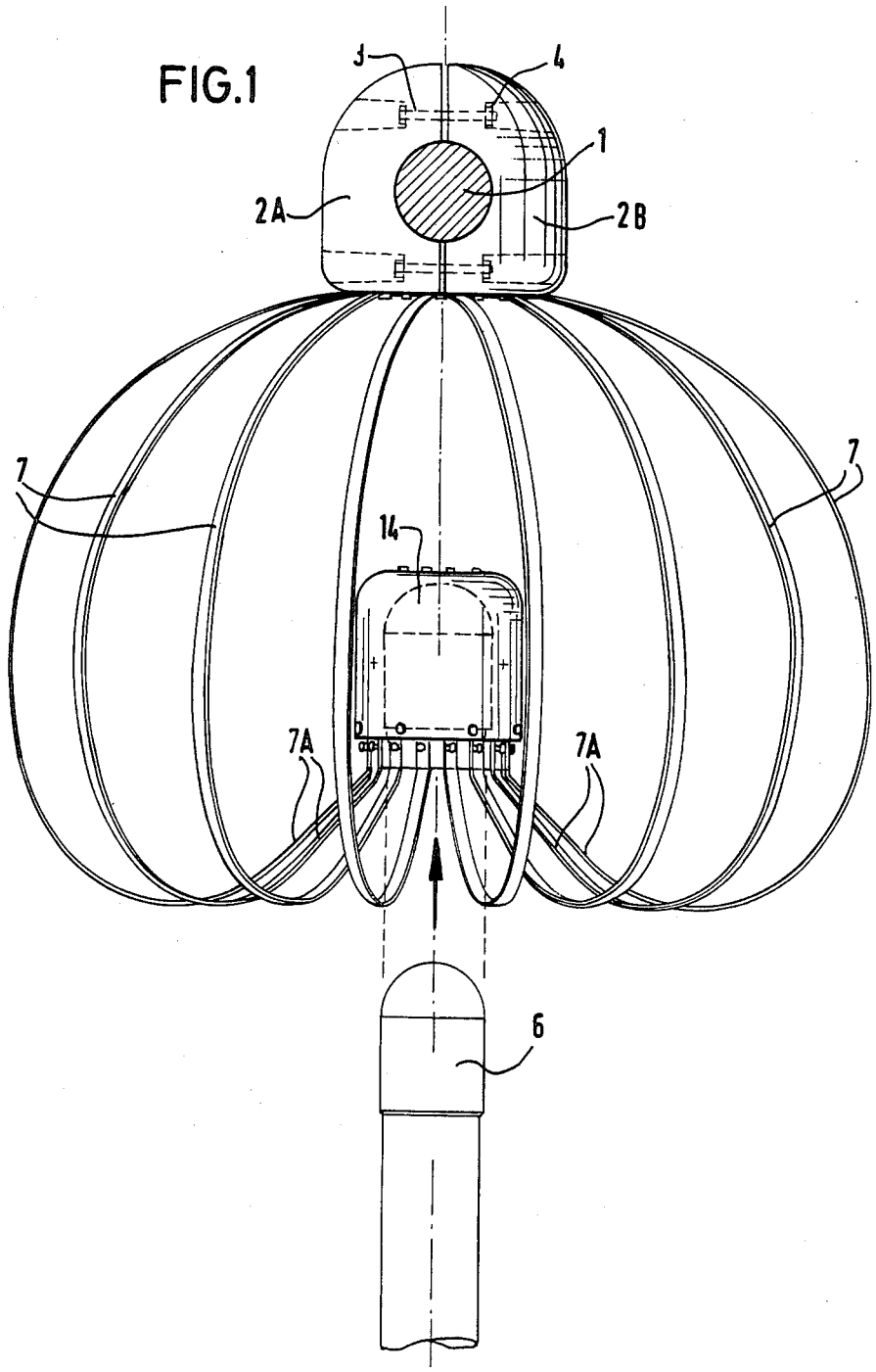
FIG. 1 is an elevation of a connector in accordance with the invention.
Figure 2:
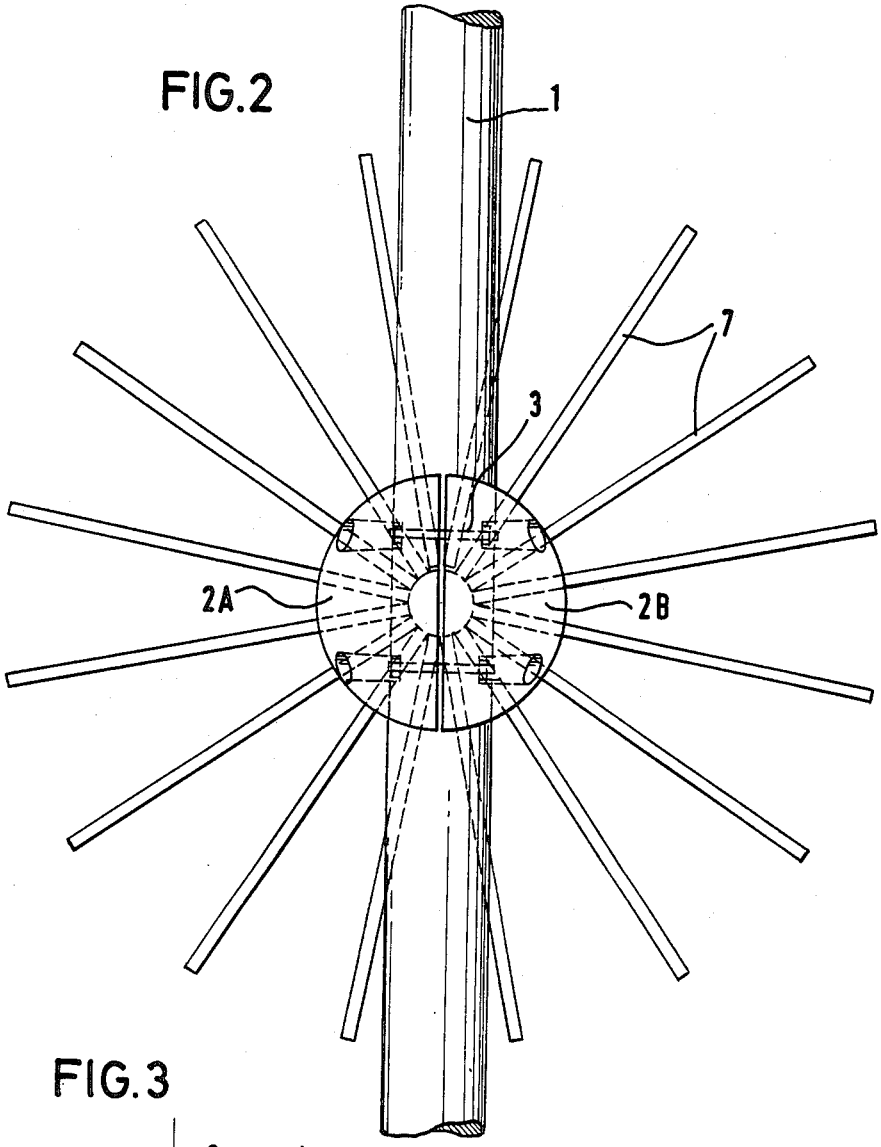
FIG. 2 is a plan view of the connector.

In FIGS. 1 and 2, reference 1 designates the overhead conductor to which the female connector portion in accordance with the invention is fixed. The connector comprises a metal block made up of two parts 2A and 2B which are clamped on the overhead conductor 1. Threaded tie rods such as 3 co-operate with nuts such as 4 to provide adequate contact pressure between the block and the overhead conductor. The block is solid in order to confer sufficient weight to the connector for it to oppose the penetration force of the male connector portion 6.

Figure 3:
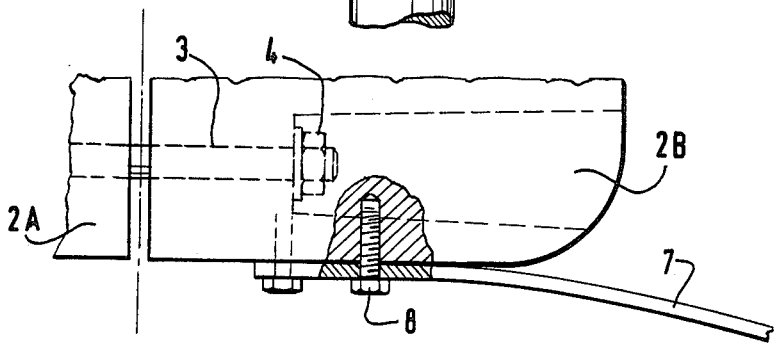
FIG. 3 is a view of a portion of FIG. 1 drawn to a larger scale.

Flat conductor strips such as 7 are fixed, at one end, to the block 2A–2B. They are disposed along radial lines projecting from the block and they are fixed thereto by screws 8 which also serve to ensure good electrical contact (see FIG. 3).

Sufficient strip conductors of sufficient width are provided to ensure an adequate contact area with the male portion of the connector. This is because each strip bears one or two contact tabs which establish electrical contact with the male portion, as described below.

The cross sectional area of the strip conductors is then determined so as to ensure that current passes in accordance with specifications. In any event, the current is equally distributed between the strip conductors.

Figure 4:
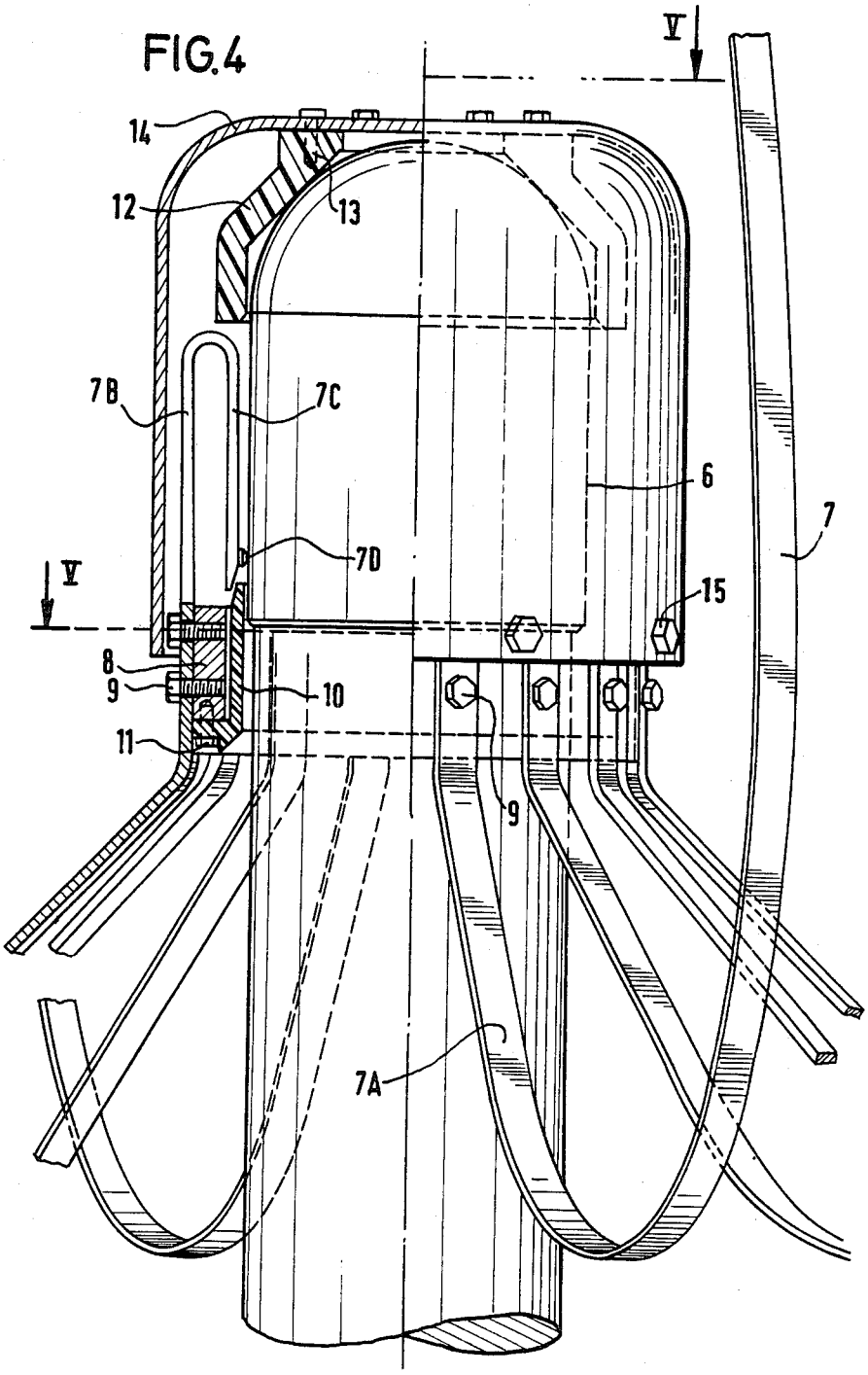
FIG. 4 is an elevation view in partial section of a portion of the connector shown in FIG. 1.
Figure 5:
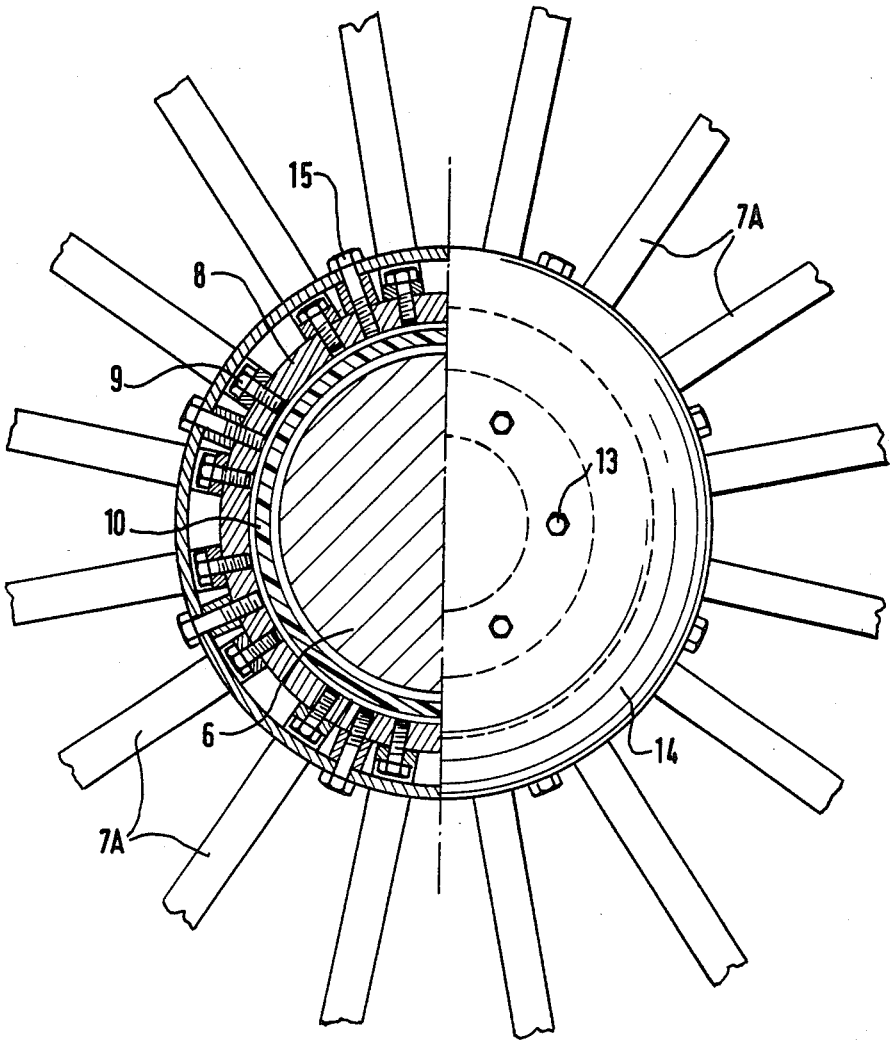
FIG. 5 is a section on a line V—V of FIG. 4.

In the example described there are sixteen strip conductors which are curved so as to constitute the meridians of a substantially spherical surface and which then include a sloping rectilinear portion 7A such that the sixteen rectilinear portions define a substantially conical inlet for the male connector portion 6 (see FIGS. 1 and 4).

The top ends of the sloping rectilinear portions 7A are fixed to a ring 8 by bolts 9. The strip conductors then project upwardly from the ring 8 prior to a hairpin bend after which they extend downwardly. Thus the end of each conductor strip is constituted by two arms 7B and 7C, FIG. 4, of a hairpin bend and the sixteen innermost arms 7C delimit a cylindrical surface for receiving the male connector portion 6.

Contact tabs 7D are fixed near the ends of the innermost arms 7C for making contact with the male portion 6.

The bottom of the cylinder in which the male contact is received includes an insulating lining 10 which is fixed to the ring 8 by screws 11.

The top of said cylinder in which the male portion 6 is received is closed by a frusto-conical end stop 12 which is screwed at 13 to a protective metal cap 14 which is itself fixed by screws 15 to the ring 8.

The novel shape of the connector in accordance with the invention provides numerous advantages:

the male connector portion engages a guide zone constituted by the sloping rectilinear portions 7A of the strip conductors 7;

during insertion, the conductors 7 bend, thereby providing mechanical resistance into which the male portion can penetrate, and the mechanical reaction to said resistance is provided by the block 2A, 2B and by the overhead conductor;

the conductors 7 convey both nominal current and short circuit current;

the generally spherical shape of the connector inhibits glow discharging; and the hairpin bends at the ends of the strip conductors provide increased contact pressure due to the electromagnetic effect.

Figure 6:
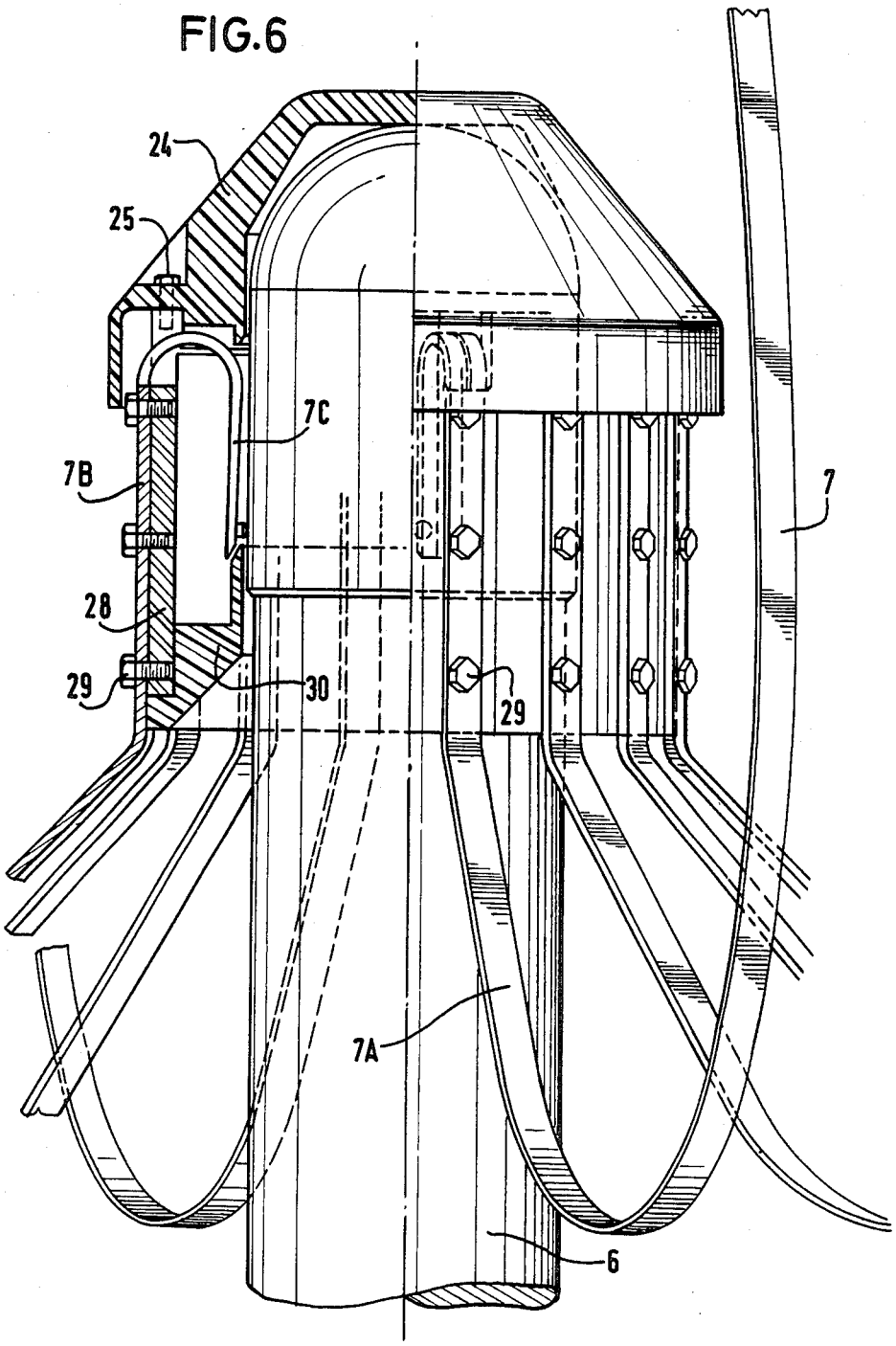
FIG. 6 is an elevation view in partial section of the bottom portion of a variant embodiment of the invention.

FIG. 6 shows a variant embodiment of the bottom portion of the connector. In this embodiment the strip conductors 7 still include sloping rectilinear portions 7A defining an inlet cone and ending in hairpin bend portions 7B, 7C.

However in this embodiment the ring 28 to which the conductors are fixed extends further in the vertical direction, thereby enabling each conductor strip to be fixed thereto by three bolts such as 29, for example.

The ring 28 is likewise fitted with a protective cap 24, but in this embodiment the cap 24 is made of insulating material and serves directly as the end stop for the male portion 6.

The cap 24 is fixed to the ring 28 by screws 25.

The top edge of the ring 28 is crenellated. The conductors 7B, 7C pass through the gaps between the teeth, while the screws 25 are screwed into the tops of the teeth.

The inlet cone is extended by a conical portion of insulating lining 30 which is fixed to the bottom of the ring 28 by means not shown.

The above-described examples make use of strip conductors 7. Naturally, this is merely by way of example and other conductor shapes may be used. In particular, the edges of the strips may be rounded, or the conductor strips may be completely round in section, etc . . . .

We claim:

1. In a connector for electrical and mechanical connection to an overhead conductor and for constituting the female connector portion of a telescopic isolating switch suitable for co-operating electrical engagement with a male connector portion of said switch, the improvement whereby said female connector portion comprises a plurality of metal conductors which are curved and regularly circumferentially spaced in such a manner as to define meridians of a substantially spherical member, means for fixing the top ends of said conductors to a metal block, said block being electrically connected and mechanically fixed to said overhead conductor, the bottom ends of said curved metal conductors each including a rectilinear portion which is inclined relative to the vertical and extending inwardly and upwardly in such a manner as to define an inlet cone for said male connector portion, followed by a hairpin bend portion having two arms, including a radially inward one which serves as a contact finger for making electrical contact with the male connector portion.

2. A connector according to claim 1, where each of said metal conductors is fixed to a circular ring by the other of the arms of its hairpin bend portion.

3. A connector according to claim 2, wherein said circular ring includes an insulating lining which extends the inlet cone constituted by said rectilinear portions of said metal conductors.

4. A connector according to claim 2, wherein said hairpin bend portions of said metal conductors as a set, are covered by a cylindrical cap which is fixed to said circular ring.

5. A connector according to claim 4, wherein said cap is electrically insulating.

6. A connector according to claim 4, wherein said cap is electrically conductive and includes a frusto-conical insulating stop fixed thereto for engaging the male connector portion.

* * * * *